US008265530B2

(12) United States Patent
Maeda

(10) Patent No.: US 8,265,530 B2
(45) Date of Patent: Sep. 11, 2012

(54) DEVELOPER CARRYING DEVICE AND IMAGE FORMING DEVICE

(75) Inventor: Masataka Maeda, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 440 days.

(21) Appl. No.: 12/562,923

(22) Filed: Sep. 18, 2009

(65) Prior Publication Data

US 2010/0074657 A1 Mar. 25, 2010

Related U.S. Application Data

(63) Continuation-in-part of application No. PCT/JP2008/050498, filed on Jan. 17, 2008.

(30) Foreign Application Priority Data

Mar. 19, 2007 (JP) ..... 2007-071029

(51) Int. Cl.
*G03G 15/18* (2006.01)

(52) U.S. Cl. ..... 399/289; 399/291

(58) Field of Classification Search ..... 399/258, 399/265, 266, 289–294
See application file for complete search history.

(56) References Cited

U.S. PATENT DOCUMENTS 4,558,941 A * 12/1985 Nosaki et al. ..... 399/266
2003/0118376 A1 6/2003 Adachi et al.

FOREIGN PATENT DOCUMENTS

| | | |
|---|---|---|
| JP | 59-181374 | 10/1984 |
| JP | 61-174561 | 8/1986 |
| JP | 07-064390 | 3/1995 |
| JP | 2003-195633 | 7/2003 |
| JP | 2004-219767 | 8/2004 |
| JP | 2004-340996 | 12/2004 |

OTHER PUBLICATIONS

International Search Report PCT/JP2008/050498.
International Preliminary Report on Patentability for International Application No. PCT/JP2008/050498 mailed Oct. 1, 2009.

* cited by examiner

*Primary Examiner* — David M Gray
*Assistant Examiner* — Barnabas Fekete
(74) *Attorney, Agent, or Firm* — Banner & Witcoff, Ltd.

(57) ABSTRACT

A developer carrying device is provided with a group of carrying electrodes configured to form a traveling wave field as voltages are sequentially applied thereto, charged developer being carried by an effect of the traveling wave field, a developer carrying member having a surface on which the group of carrying electrodes are arranged, and a plurality of leveling electrodes provided above the surface and configured to form electric fields in a direction substantially along the surface, the plurality of leveling electrodes being needle like electrodes extending in a direction intersecting with the surface, the plurality of leveling electrodes being spaced from each other in a direction along the surface and intersecting with a direction in which the developer is carried.

18 Claims, 14 Drawing Sheets

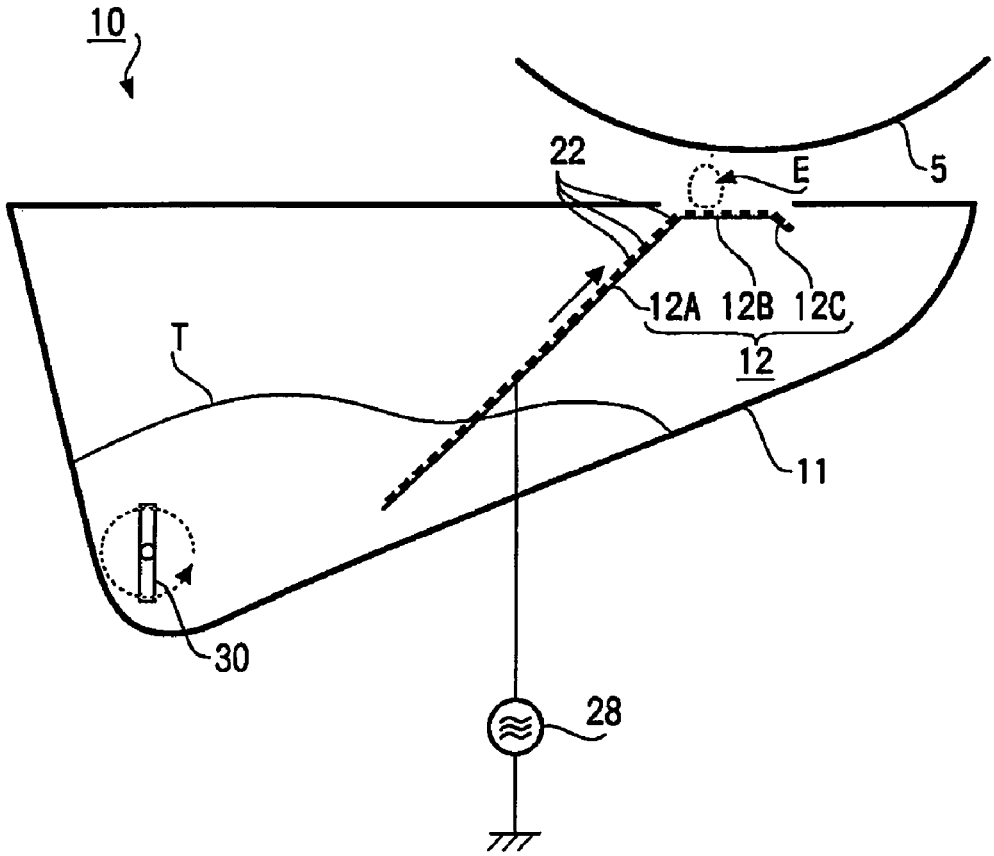
FIG. 2
FIG.3A
FIG.3B
FIG.3C
FIG.3D
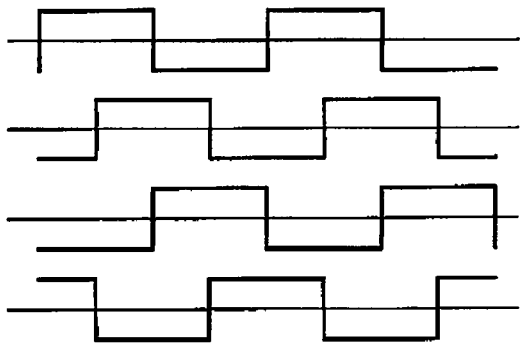

DEVELOPER CARRYING DEVICE AND IMAGE FORMING DEVICE

CROSS-REFERENCE TO RELATED APPLICATIONS

This is a Continuation-in-Part of International Application No. PCT/JP2008/050498 filed on Jan. 17, 2008, which claims priority from Japanese Patent Application No. 2007-071029 filed on Mar. 19, 2007. The entire disclosure of the prior applications is hereby incorporated by reference herein its entirety.

BACKGROUND

1. Technical Field

The present invention relates to a developer carrying device for carrying charged developer with a travelling wave electric field, and an image forming device employing such a developer carrying device.

2. Prior Art

Conventionally, a developer carrying device making use of a travelling wave field has been known for carrying charged developer (e.g., toner). Such a developer carrying device includes a group of carrying electrodes, which form the travelling wave field as voltages are sequentially applied thereto. In the developer, a carrying path for carrying the developer is defined, and the group of carrying electrodes are arranged on the surface of the carrying path.

In the developer carrying device of this type, the developer needs to be leveled uniformly in a width direction (i.e., a direction perpendicular to the direction in which the developer is carried). For this purpose, in a conventional device, employed are a group of opposed electrodes, which are linear electrodes arranged in a width direction, facing the surface of the group of carrying electrodes, and spaced from each other by a predetermined distance.

SUMMARY

Practically, in order to level the developer by adopting the conventional configuration as described above, it may be necessary to arrange the group of opposing electrodes at such a lower position that the opposing electrodes almost contact the developer carried on the carrying path. However, such a configuration (i.e., arrangement of the opposing electrodes) may mechanically interfere with carrying of the developer.

In consideration of the above, aspects of the invention provide an improved developer carrying device, which employs the travelling wave field for carrying the developer, and a plurality of electrodes for leveling the developer in the width direction without mechanically interfering with carrying of the developer.

According to aspects of the invention, there is provided a developer carrying device, which is provided with a group of carrying electrodes configured to form a traveling wave field as voltages are sequentially applied thereto, charged developer being carried by an effect of the traveling wave field, a developer carrying member having a surface on which the group of carrying electrodes are arranged, and a plurality of leveling electrodes provided above the surface and configured to form electric fields in a direction substantially along the surface, the plurality of leveling electrodes being needle like electrodes extending in a direction intersecting with the surface, the plurality of leveling electrodes being spaced from each other in a direction along the surface and intersecting with a direction in which the developer is carried.

According to aspects of the invention, there is also provided a developer carrying device, which is provided with a group of carrying electrodes configured to form a traveling wave field as voltages are sequentially applied thereto, charged developer being carried by an effect of the traveling wave field, a developer carrying member having a surface on which the group of carrying electrodes are arranged, and a plurality of leveling electrodes provided on the surface and configured to form electric fields in a direction intersecting with the direction in which the developer is carried, the plurality of leveling electrodes being aligned in a direction intersecting with a direction in which the developer is carried.

According to aspects of the invention, there is also provided an image forming device employing the developer carrying devices as above.

BRIEF DESCRIPTION OF THE ACCOMPANYING DRAWINGS

FIG. 2 is an internal side view schematically illustrating a configuration of a developing unit of the laser printer according to the embodiment of the invention.

FIGS. 3A-3D illustrates an example of rectangular alternating voltages applied to the group of electrodes.

DETAILED DESCRIPTION OF THE EMBODIMENTS

Overall Architecture of Laser Printer

Hereinafter, referring to the accompanying drawings, a laser printer 1 according to embodiments of the present invention will be described. The laser printer 1 is configured to feed print sheets P accommodated in a sheet feeding tray (not shown) one by one, and form images on print sheets P with toner T.

Figure 1:
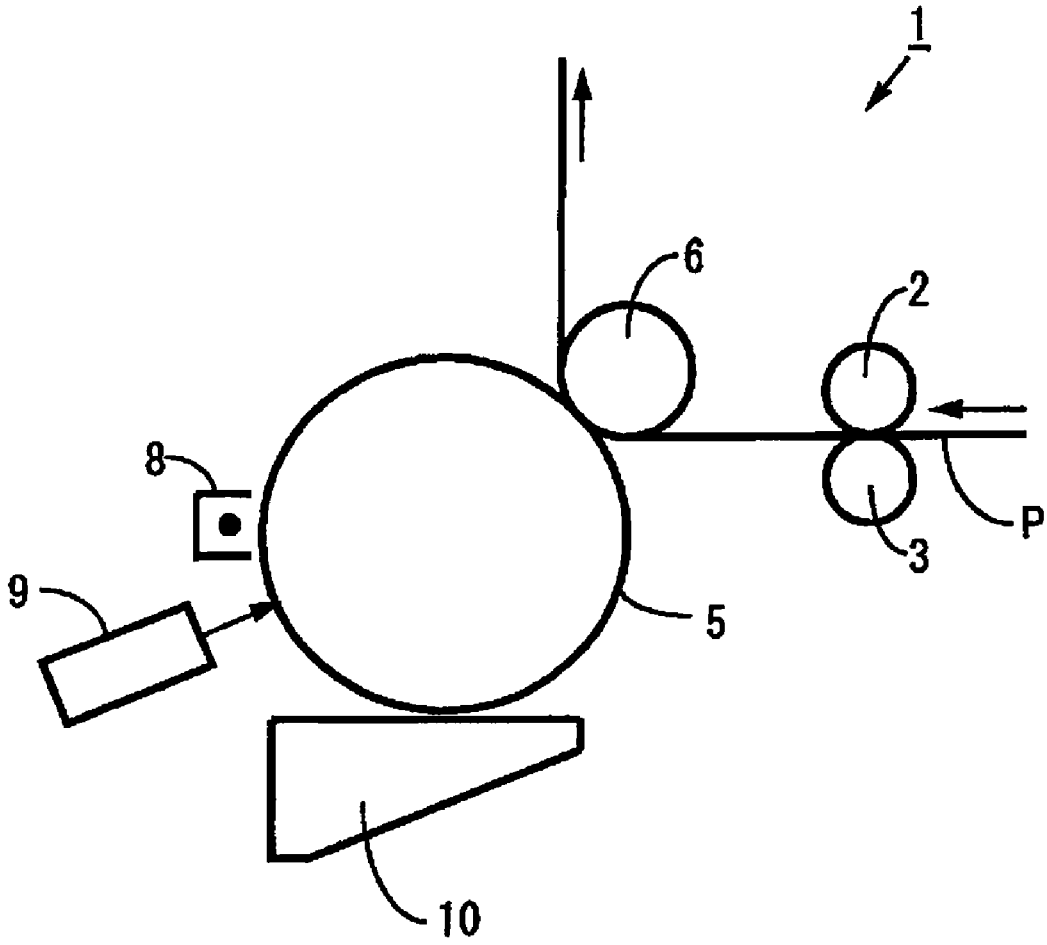
FIG. 1 is a schematic diagram illustrating main units of a laser printer according to an embodiment of the invention.

As shown in FIG. 1, which shows main units of the laser printer 1, the laser printer 1 has register rollers 2 and 3 which catch the leading end of the print sheet P fed from the document feeding tray, and feed the print sheet P to a nip between a photosensitive drum 5 and a transfer roller 6 at a predetermined timing for image formation.

The photosensitive drum 5 is configured such that the main body thereof is grounded. On the circumferential surface of the photosensitive drum 5, a positively chargeable photosensitive layer made of an organic photosensitive material such as polycarbonate is formed. The photosensitive drum 5 is supported inside the laser printer 1 such that the photosensitive drum 5 is rotatable in the counterclockwise direction in FIG. 1.

Around the outer circumference of the photosensitive drum 5, a charger 8, a laser scanner unit 9 and a developing unit 10 are arranged in this order, from an upstream side in the rotation direction. The charger 8 is a scorotron type charger for positive charging the photosensitive drum 5 by generating a corona discharge from a charging wire made of tungsten, for example. The charger 8 is configured to charge the circumferential surface of the photosensitive drum 5 positively and uniformly.

The laser scanner unit 9 is configured such that a laser source emits a laser beam, which is modulated in accordance with image data input from outside. The laser beam is incident on mirror surfaces of a rotating polygon mirror so that the reflected laser beam scans, the scanning laser beam being incident on the surface of the photosensitive drum 5 to form a electrostatic latent image. Such a function of the laser scanner unit 9 is of a well-known type and will not be described in further detail for brevity.

The developing unit 10 is arranged below the photosensitive drum 5, and supplies the positively charged toner T to the circumferential surface of the photosensitive drum 5. Incidentally, according to the embodiment, a non-magnetic one-component polymerized toner is used as the toner T.

Specifically, the circumferential surface of the photosensitive drum 5 is positively and uniformly charged with the charger 8, as the photosensitive drum 5 rotates. Then, the surface of the photosensitive drum 5 is exposed to the high-speed scanning of the laser beam emitted from the laser scanner unit 9. Since the scanning laser beam is modulated in accordance with the image data, an electrostatic latent image corresponding to the image data is formed on the surface of the photosensitive drum 5.

Subsequently, when the positively charged toner T is supplied from the developing unit 10 to the photosensitive drum 5, the toner T is supplied (attracted) onto the electrostatic latent image formed on the surface of the photosensitive drum 5. That is, the voltage potential of the exposed potions of the surface of the photosensitive drum 5 is lowered in comparison with the electric potential of non-exposed portions of the positively and uniformly charged surface of the photosensitive drum. Thus, the positively charged toner is selectively attracted by the electrostatic latent image and selectively supported thereat. In this manner, the electrostatic latent image turns into a visible image (i.e., developed), and a toner image is formed.

The transfer roller 6 is rotatably supported in the laser printer 1 so as to be rotatable in the clockwise direction in FIG. 1. According to the embodiment, the transfer roller 6 has a metal roller shaft covered with an ion-conductive rubber material. When the toner image is transferred to the print sheet P, a transfer bias (a transfer normal bias) is applied to the transfer roller 6 from a transfer bias supply (not shown). With the above-described configuration, when the print sheet passes through the nip between the photosensitive drum 5 and the transfer roller 6, the toner image formed on the surface of the photosensitive drum 5 is transferred to the print sheet P. Although not shown in the drawings, the print sheet P bearing the toner image is fed to a fixing unit which typically includes a heating roller and a pressure roller, and the toner image is fixed, with heat and pressure, on the print sheet P as in a well-known electrophotographic printer. Thereafter, the print sheet P is ejected onto an sheet ejection tray.

Structure of Developing Unit

As shown in FIG. 2, the developing unit 10 includes a hopper 11 which holds the toner T therein. The hopper 11 has an opening on the top surface thereof. The opening is located below the photosensitive drum 5 (i.e., faces the photosensitive drum 5). Further, the bottom surface of the hopper 11 is inclined with respect to the top surface such that the depth of the hopper 11 gradually increases from one end to the other.

Inside the hopper 11, a carrying plate 12 is provided. The carrying plate 12 includes a long inclined plate section 12A which diagonally extends, a horizontal plate section 12B and a short inclined plate section 12C. One end of the long inclined plate section 12A is located at a position close to the bottom surface of the hopper 11 and the other end of the long inclined plate 12A is located at a position close to the opening formed on the top surface of the hopper 11. With the other end of the long inclined plate section 12A, a horizontal plate section 12B is connected. The horizontal plate section 12B extends substantially horizontally to face the photosensitive drum 5 through the opening formed on the top surface of the hopper 11. Further, a short inclined plate section 12C is connected with the horizontal plate section 12B on the opposite side of the long inclined plate section 12A. The short inclined plate section 12C extends from the horizontal plate section and downwardly inclines.

Figure 4:
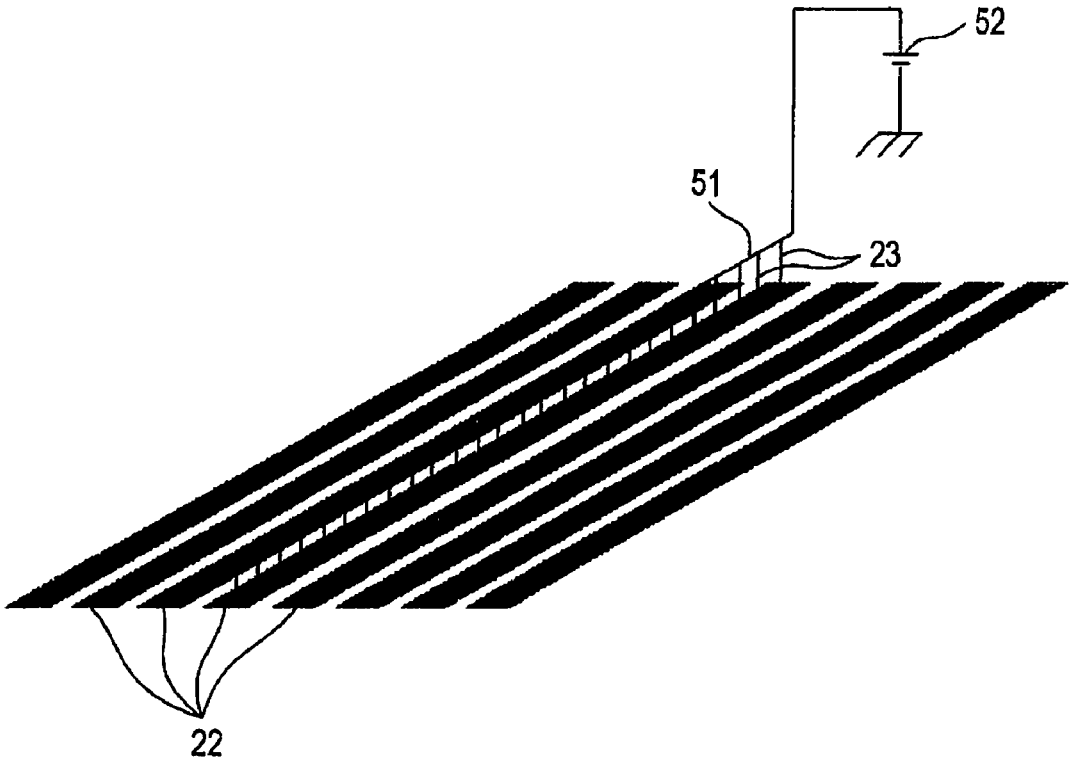
FIG. 4 is a perspective view schematically illustrating the group of electrodes electrode on a carrying plate according to a first embodiment of the invention.

A plurality of linear electrodes 22 are arranged on the surface of the carrying plate 12 (see FIG. 4, for example). The length of each electrode 22 is almost equal to the length in the width direction, which is perpendicular to the direction in which the toner is carried and perpendicular to the plane of FIG. 2, of the carrying plate 12. The electrodes 22 are provided cover almost all the surface of the carrying plate 12, the electrodes 22 being spaced equally in the length direction of the carrying plate 12 (i.e., the direction in which the toner is carried). The length of each electrode 22 in the width direction is also set to be equal to or slightly longer than the maximum width of the electrostatic latent image which may be formed on the photosensitive drum 5.

The waveform charts shown in FIGS. 3A-3D illustrate rectangular alternating voltages applied to arbitrary four neighboring linear electrodes 22 on the carrying plate 12. As indicated by the waveform charts shown in FIGS. 3A-3D, to each electrode 22, a rectangular alternating voltage, which is shifted in 90 degrees in phase with respect to the rectangular alternating voltage applied to the adjoining electrode, is applied from a rectangular alternating power supply 28. In this manner, a traveling wave field is generated on the surface of the carrying plate 12.

Therefore, the toner T held in the hopper 11 is carried on the carrying plate 12 by the traveling wave electric generated by the linear electrodes 22, and supplied to the horizontal plate section 12B facing the photosensitive drum 5. A part of the toner T is supplied to the photosensitive drum 5 in accordance with the electrostatic latent image, and the remaining toner T, which has not been supplied to the photosensitive drum 5, drops down on the one end of the hopper 11 through the short inclined plate section 12C. The dropped toner T is moved toward the other end with the inclined configuration of the bottom surface of the hopper 11. At the bottom part of the other end of the hopper 11 (at the deepest part of the hopper 11), an agitator 30 is provided to agitate and frictionally charge the toner T held in the hopper 11.

First Embodiment

Structure of Leveling Electrodes

The structure of the leveling electrodes 23 according to a first embodiment of the invention is described. As shown in FIG. 4, above one electrode 22 located on an upstream side of the horizontal plate section 12B, a plurality of needle like electrodes 23 are arranged, which are aligned in a line and equally spaced in the width direction (i.e., in the direction where the electrode 22 extends), each electrode 23 extends perpendicularly to the surface of the linear electrode 22 (namely, perpendicularly to the surface of the horizontal plate portion 12B). It is noted that, in FIG. 2, the needle like electrodes 23 are arranged at about an area E. The upper end of each electrode 23 is connected with an electric wire 51 which is arranged in parallel with the linear electrodes 22 above which the needle like electrodes 23 are arranged. A constant positive voltage, which is much higher than the voltage of the charged toner T, is applied to each electrode 23 by a direct-voltage supply 52. In the above-described embodiment, the needle like electrodes are arranged above the electrode 22 provided on the horizontal plate section 12B. Alternatively, the electrodes 23 may be arranged above the electrode provided on the long inclined plate section 12A.

Figure 5A:
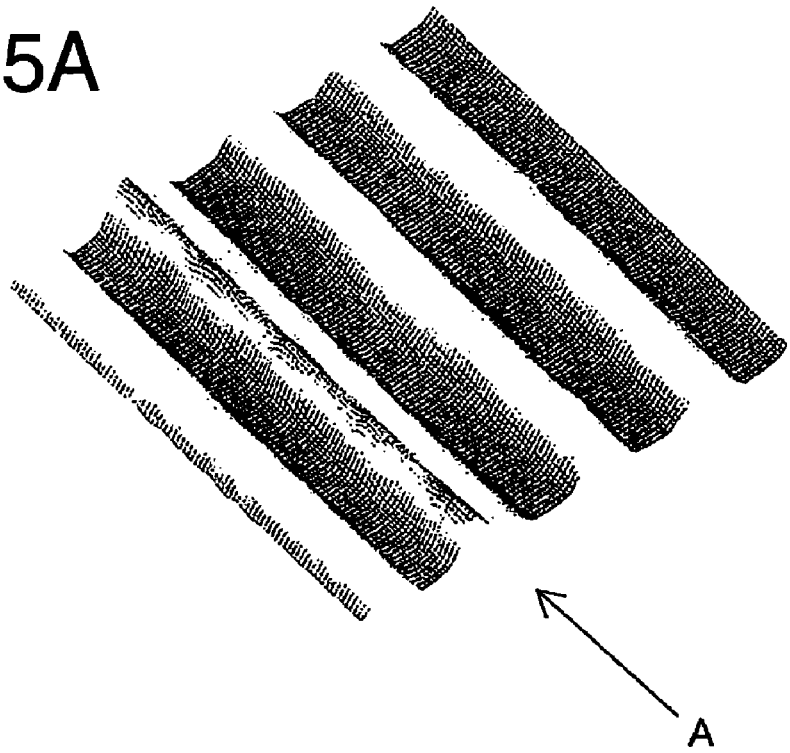
FIGS. 5A and 5B are electric field distribution charts showing effects of leveling electrodes.
Figure 5B:
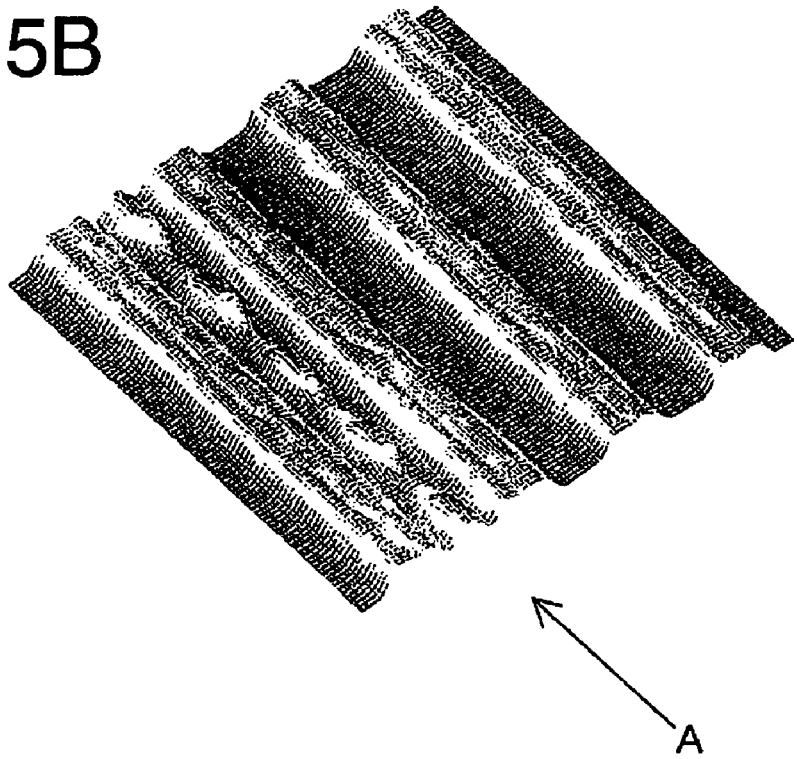

The traveling wave electric field generated by the linear electrodes 22 propagates in a wavelike fashion, as illustrated in the electric field distribution charts in FIGS. 5A and 5B (the upward direction indicates a positive potential), and carries the toner T. The intensity of the electric fields at the neighborhoods of electrodes 23 are so strong that the positively charged toner T cannot contact the electrodes 23 (see the portions indicated by arrow A in FIGS. 5A and 5B). Therefore, when a negative voltage is applied to the linear electrode 22 that faces the electrodes 23, the toner T, which is carried from the upstream side, is carried, as if it circumvents the electrodes 23, to pass through the gaps among the electrodes 23, and is carried toward the photosensitive drum 5.

As above, the toner carried by the traveling wave field is leveled in the width direction as if a sand hill is leveled by means of a rake. Further, since the electrodes 23 are formed in a needle like shape, the electrodes 23 almost do not mechanically interfere with the carrying of the toner T by the traveling wave field. Therefore, according to the first embodiment, the toner T can be well leveled in the width direction without any mechanical interference with the carrying of the toner T. Therefore, in the laser printer 1, the electrostatic latent image formed on the photosensitive drum 5 can be uniformly developed, and an excellent image, which is free from unevenness in the image density, can be formed on the print sheet P.

As is understood from FIG. 5B, the effect of applying voltage to the electrodes 23 is more prominent when a negative voltage is applied to the linear electrode 22 that face the electrodes 23. Thus, control is made such that a positive voltage is applied to the electrodes 23 only when a negative voltage is applied to the linear electrode 22 facing the electrodes 23. Conversely, control is made such that a negative voltage is applied to the electrodes 23 only when a positive voltage is applied to the linear electrode 22 facing the electrodes. Optionally, both controls may be used.

Second Embodiment

Structure of Leveling Electrodes

Figure 6:
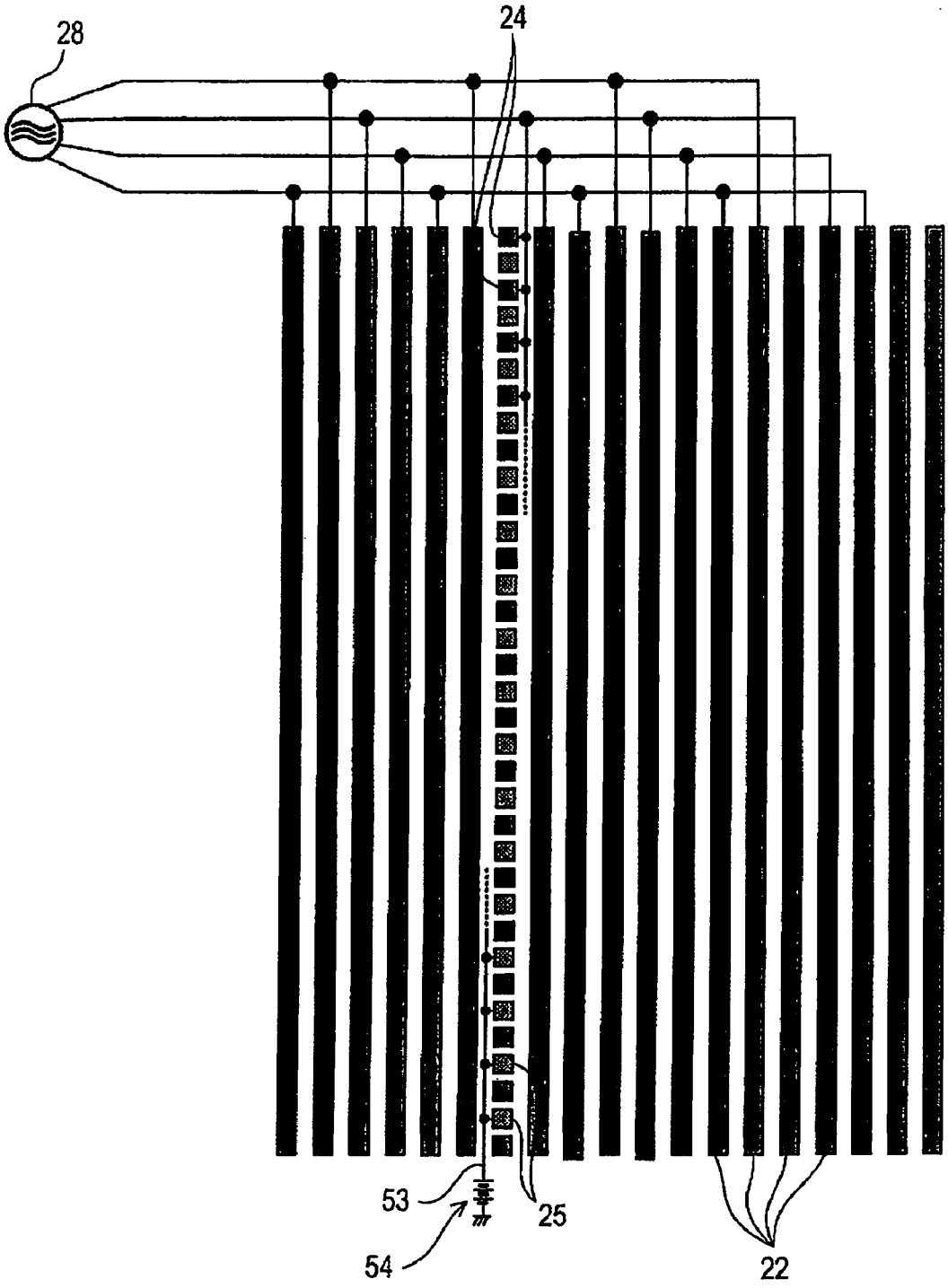
FIG. 6 is a plan view schematically illustrating a configuration of the electrodes on the carrying plate according to a second embodiment of the invention.

Next, leveling electrodes according to a second embodiment will be described. The configuration of the laser printer 1 according to the second embodiment is the same as that of the first embodiment except for the structure of the leveling electrodes. In the second embodiment, as shown in FIG. 6, an electrode 22, which is located on upstream side of the horizontal plate section 12B (i.e., upstream side with respect to a portion, of the horizontal plate section 12B, facing the photosensitive drum 5), is divided into multiple pieces of small electrodes 24 and 25 in the width direction. The small electrodes 24 and 25 are alternately arranged, and the small electrodes 24 are connected to the rectangular alternating-voltage supply 28 as in the case of the linear electrode 22. Therefore, the small electrodes 24 form a group of electrodes which function similar to the other linear electrodes 22, and contribute to carry the toner T by generating the traveling wave field. The electrodes 25 are connected with a direct-voltage supply 54 through an electric wire 53 which is wired, on the carrying plate 12, between the adjoining electrode 22 and the electrodes 25.

Therefore, the electric potential is high in the neighborhoods of the electrodes 25, and the toner T can be leveled in the width direction as in the case of the first embodiment. Further, since the electrodes 25 are arranged on the carrying plate 12 similarly to the linear electrodes 22, the electrodes 25 almost do not mechanically interfere with the carrying of the toner T. Accordingly, in the second embodiment, the toner T can be effectively leveled in the width direction without any mechanical interference with the carried toner T. Therefore, in the laser printer 1, the electrostatic latent image formed on the photosensitive drum 5 can be developed uniformly, and an excellent image, which is free from the unevenness density, can be formed on the print sheet P. Incidentally, a constant voltage of 0V may be applied to the electrodes 24, instead of the rectangular wave voltage for carrying. In this case, although the capability of carrying the toner T is slightly lowered, it is also possible to level the toner T almost similarly to the case of the above-described second embodiment.

Third Embodiment

Structure of Leveling Electrodes

Figure 7:
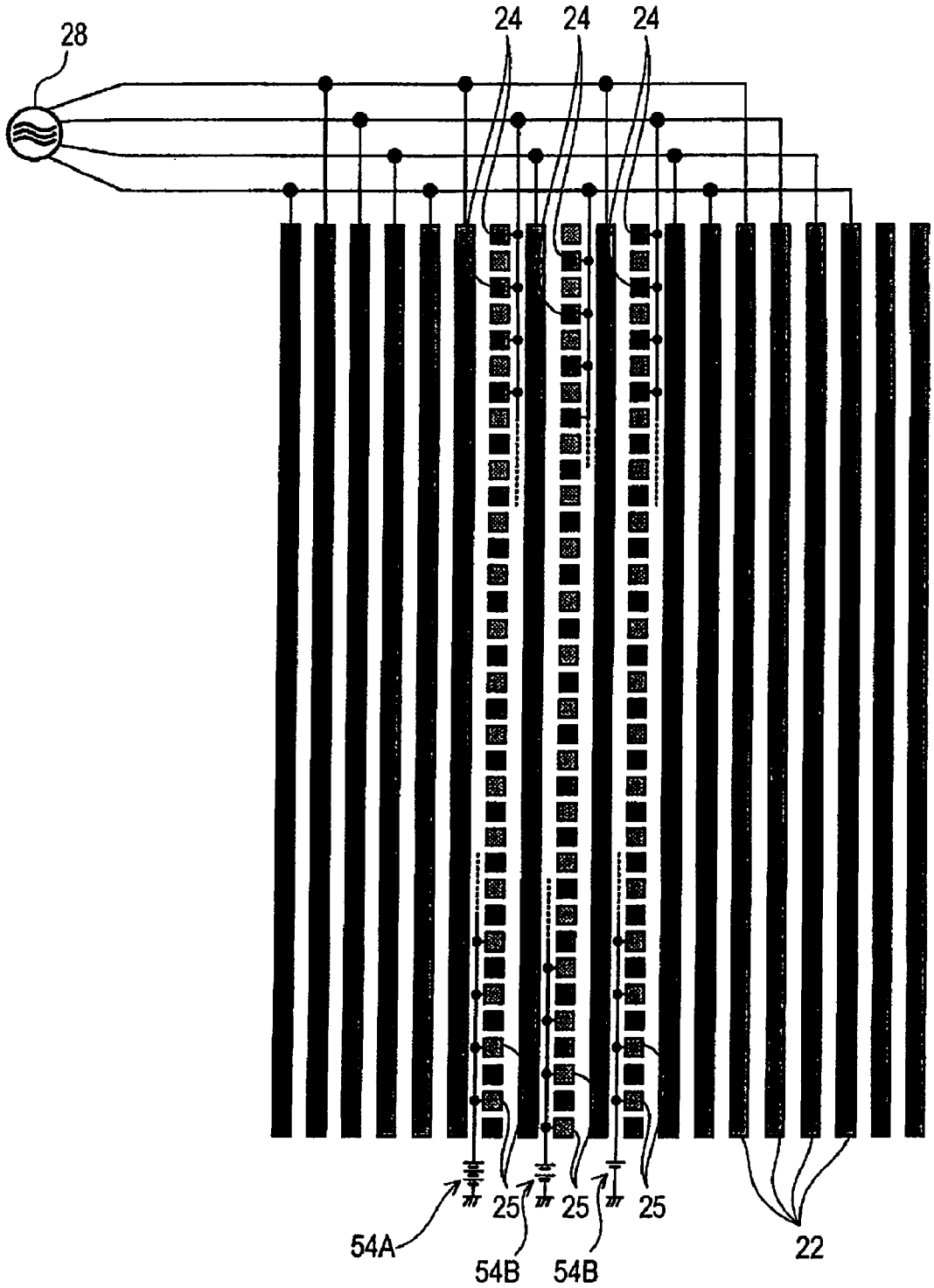
FIG. 7 is a plan view schematically illustrating a configuration of the electrodes on the carrying plate according to a third embodiment of the invention.

In the second embodiment, only one line of electrodes 24 and 25 are provided. However, in a third embodiment as illustrated in FIG. 7, a plurality of lines of electrodes 24 and 25 are provided. In the example shown in FIG. 7, three lines of electrodes 24 and 25 are provided and one linear electrode 22 is arranged in each of the gaps between two neighboring lines of the electrodes 24 and 25. It should be noted that the spacing of the electrodes 24 and 25 in the direction in which the toner is carried and the number of the lines of the electrodes 24 and 25 are not limited to those of the third embodiment. Further, in the third embodiment, every three neighboring lines of electrodes 25 are connected to direct-current power supplies 54A, 54B, and 54C, respectively, in the order from the upstream side to the down stream side in the direction in which the toner is carried, respectively. The absolute values of the positive voltages applied by the direct-current power supplies 54A, 54B, and 54C, are gradually reduced in this order (however, the voltage applied to the electrodes 25 by each of the direct-current power supplies 54A, 54B, and 54C is much higher than the voltage of the charged toner T). In addition, in the third embodiment, the electrodes 24 and 25 are alternated also in the direction in which the toner is carried.

Therefore, in the third embodiment, as described below, the toner T can be more effectively leveled than it can be in the second embodiment. Firstly, since there are plurality of lines of the electrodes 24 and 25, the toner can be leveled with the electrodes 25 by a plurality of times, repeatedly. Secondly, since the electrodes 24 and 25 are arranged alternately in the direction in which the toner is carried, the direction of the force applied to the toner T in the width direction alternates, as the toner T is carried by the traveling wave field. Thus, the toner T can be more effectively leveled. Furthermore, since the absolute values of the voltages applied by the direct-current power sources 54A, 54B, and 54C are gradually reduced in this order, re-arising of unevenness of the toner distribution in the width direction can be suppressed once the toner T has been leveled.

Although not shown in the drawings, the first embodiment employing the needle like electrodes 23 can be modified such that a plurality of lines of electrodes 23 are arranged above the plurality of electrodes 22. In this case, the plurality of lines of electrodes 23 may be arranged such that the electrodes 23 of each line do not overlap when viewed along the direction in which the toner T is carried, and the absolute values of the voltages applied to the respective lines of electrodes 23 are gradually lowered from the upstream side to the down stream side in the toner carrying direction.

Fourth Embodiment

Structure of Leveling Electrodes

Figure 8:
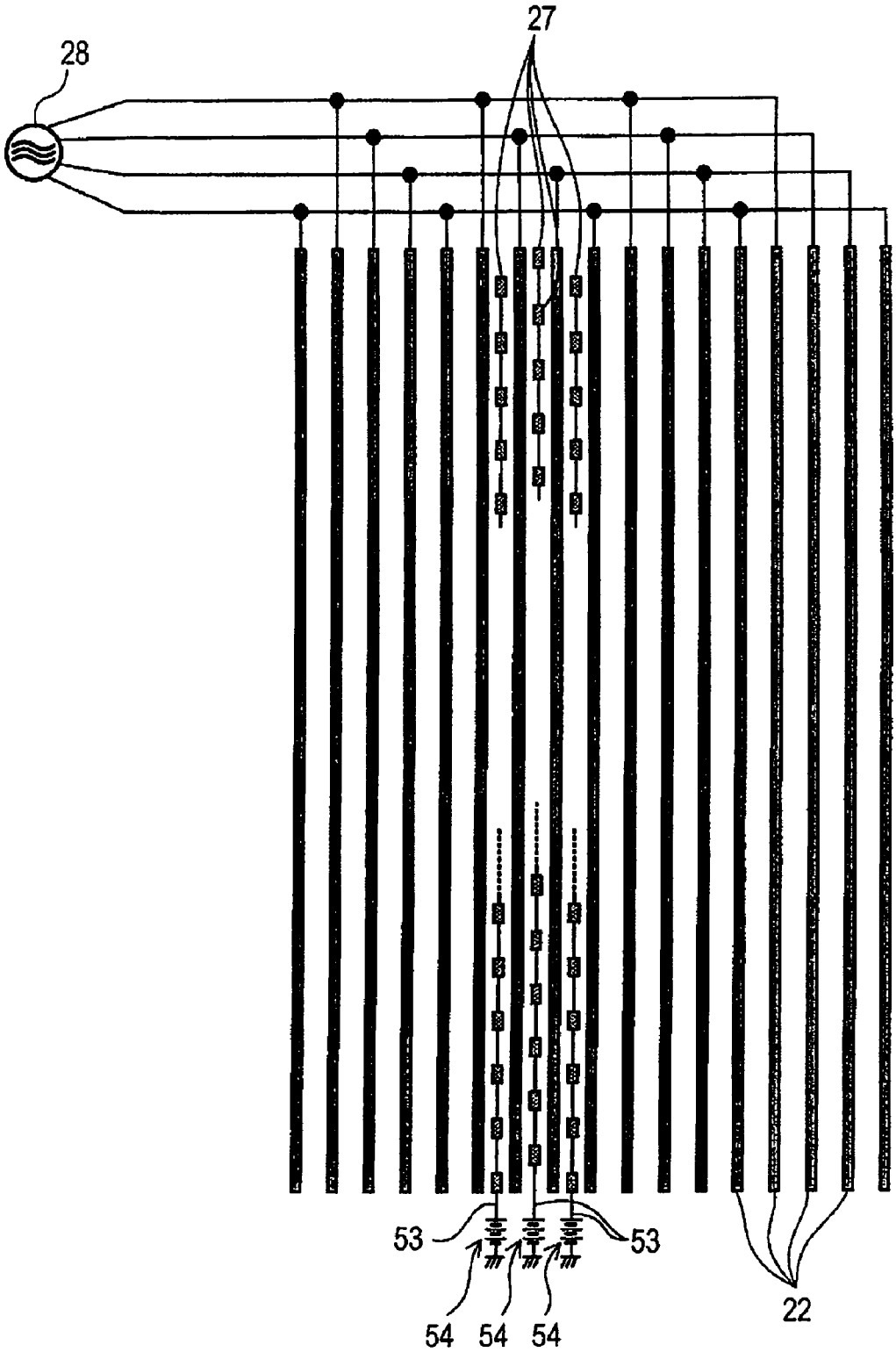
FIG. 8 is a plan view schematically illustrating a configuration of electrodes on a carrying plate according to a fourth embodiment of the invention.

The laser printer 1 according to the fourth embodiment is the same as in the first embodiment except for the structure of the leveling electrodes. In the fourth embodiment, as schematically shown in FIG. 8, a plurality of electrodes 27 are arranged to be equally spaced in the width direction, and aligned between two neighboring linear electrodes 22 on the carrying plate 12. In the fourth embodiment shown in FIG. 8, three lines of electrodes 27 are arranged in the gaps of four neighboring lines of the electrodes 22. It should be noted that the spacing of the electrodes 27 in the same line, and the number of the lines of the electrodes 27 are not limited to those shown in FIG. 8. According to the exemplary embodiment shown in FIG. 8, the electrodes 27 in one line do not overlap the electrodes 27 in the neighboring line when viewed along the toner carrying direction. Further, the three lines of electrodes 27 are connected with three direct-voltage supplies 54 through three electric wires 53 wired on the carrying plate 12, respectively.

With the above configuration, the electric potential is high in the neighborhoods of the electrodes 27, and the toner T can be leveled as in the case of the first embodiment. Further, since the electrodes 27 are arranged on the carrying plate 12 similarly to the linear electrodes 22, the electrodes 27 almost do not mechanically interferes with the carrying of the toner T. Accordingly, in the fourth embodiment, the toner T can be effectively leveled in the width direction without any mechanical interference with the carrying of the toner T with the traveling wave field. Therefore, in the laser printer 1, the electrostatic latent image formed on the photosensitive drum 5 can be uniformly developed, and an excellent image, which is uniform in terms of density, can be formed on the print sheet P.

In addition, in the fourth embodiment, since a plurality of lines of electrodes 27 are provided, the toner T can be leveled multiple times repeatedly, and the toner T can be leveled more effectively. Further, since the electrodes 27 of one line do not overlap the electrodes 27 of the neighboring line when viewed from the toner carrying direction, the direction of the force the toner T receives in the width direction changes as the toner T proceeds. Therefore, the toner T can be leveled further effectively. Further, in the fourth embodiment, since each line of the electrodes 27 are arranged between two neighboring lines of linear electrodes 22, the driving force for carrying the toner T can be further more effectively obtained. In the fourth embodiment, the same positive voltages are applied to all the lines of the electrodes 27, however, this configuration can be modified such that the absolute values of the applied voltages are gradually lowered, as in the third embodiment.

Fifth Embodiment

Structure of Leveling Electrodes

Figure 9:
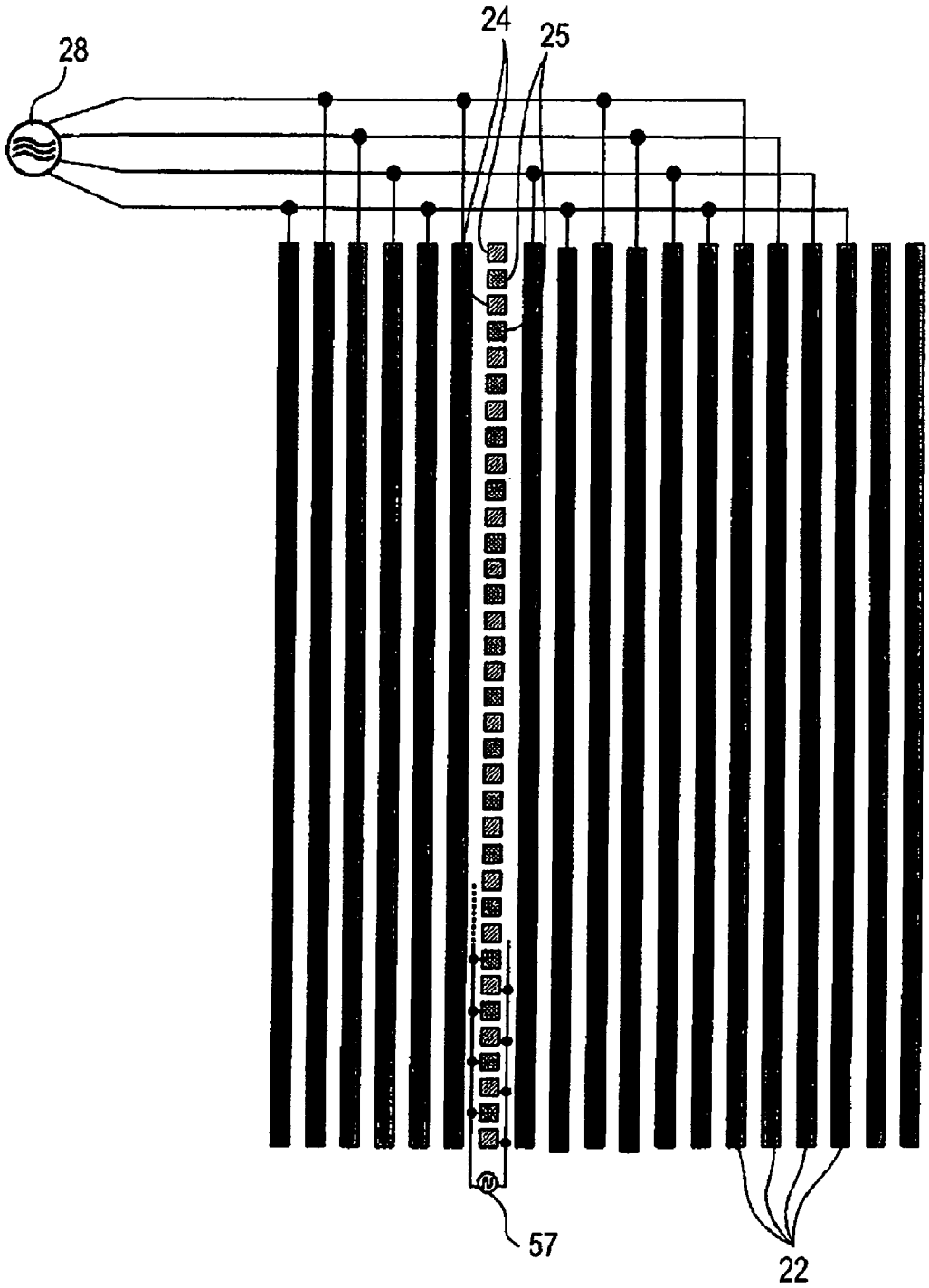
FIG. 9 is a plan view schematically illustrating a configuration of electrodes on the carrying plate according to a fifth embodiment of the invention.

In the above embodiments, direct-current voltages are applied to the electrodes 23, 25, and 27, which have the effects to level the toner T. Instead, an alternating voltage may be applied as in a fifth embodiment described below. In the fifth embodiment, as is schematically shown in FIG. 9, the electrodes 24 and electrodes 25, which are arranged similarly to the second embodiment, are connected to the single-phase rectangular alternating-voltage supply 57 at both output terminals thereof (i.e., a pair of terminals that outputs voltages of which the phases are shifted by 180 degrees). Further, the frequency of the single-phase rectangular alternating-voltage supply 57 is set to be higher than that of a four-phase rectangular alternating-voltage supply 28.

Figure 10A:
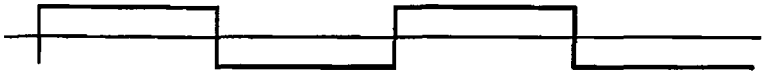
FIGS. 10A-10C show an explanatory diagram illustrating changes of voltages applied to the leveling electrodes according to a fifth embodiment of the invention.
Figure 10B:
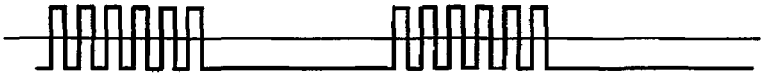
Figure 10C:
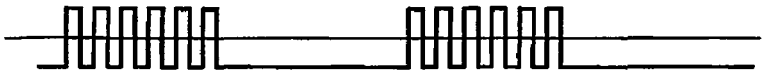

Therefore, in the fifth embodiment, the alternating voltages illustrated in FIG. 10B and FIG. 10C are applied to neighboring electrodes 24 and electrodes 25, respectively, instead of the voltage illustrated in FIG. 10A. Thus, alternating electric fields are formed between the neighboring electrodes 24 and 25. Due to the alternating electric field, the direction of the force the toner T receives in the width direction alternates rapidly, the toner T can be more effectively leveled.

Sixth Embodiment

Structure of Leveling Electrodes

Figure 11:
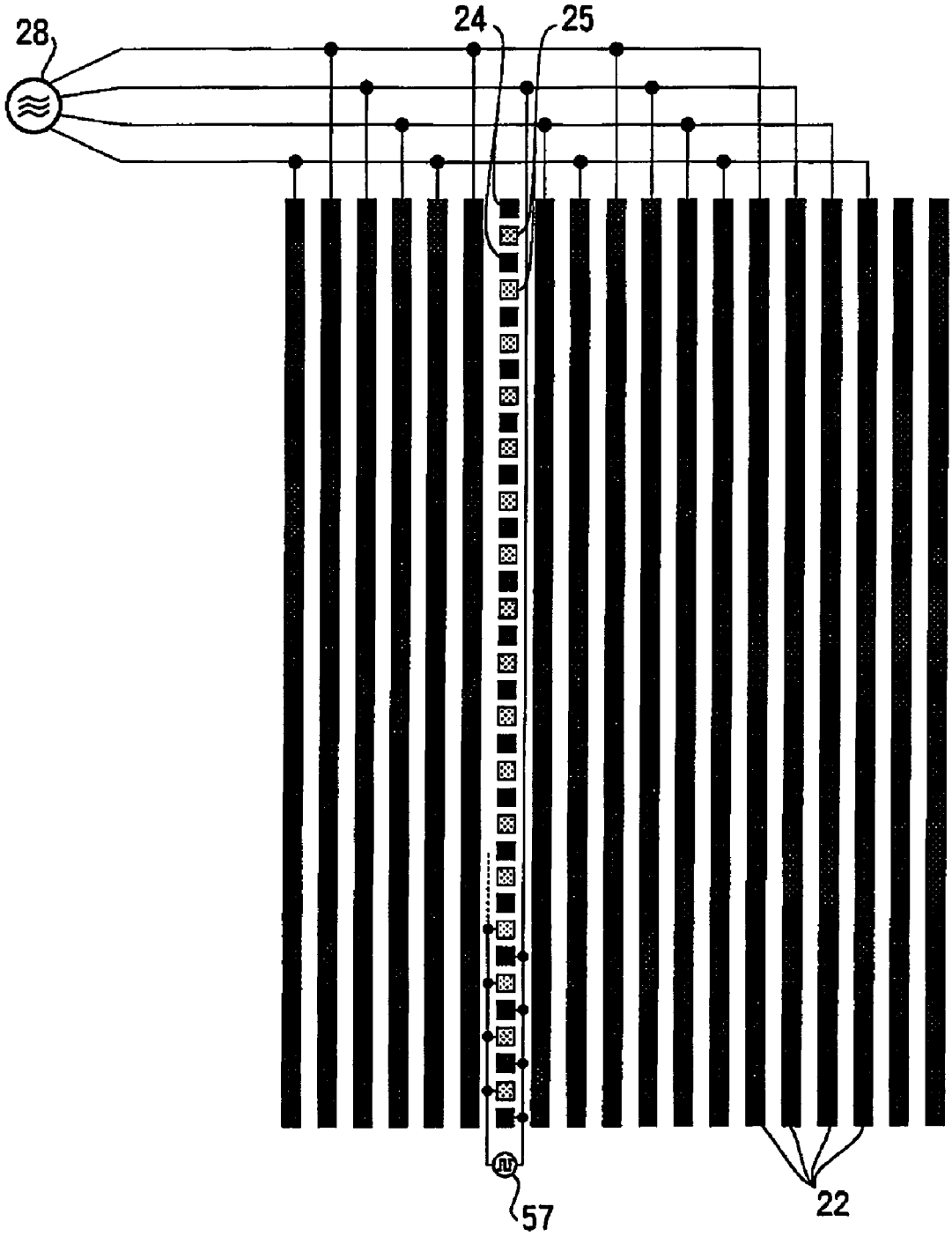
FIG. 11 is a plan view schematically illustrating a configuration of electrodes on the carrying plate according to a sixth embodiment of the invention.

According to a sixth embodiment which is schematically illustrated in FIG. 11, the electrodes 24 in the fifth embodiment are connected to the four-phase rectangular alternating-voltage supply 28. In this manner, the same rectangular alternating-voltages same as the rectangular alternating-voltages applied to the linear electrodes 22 are applied to the electrodes 24. The voltage from the rectangular alternating-voltage supply 28 and the voltage from the single-phase alternating-voltage supply 57 are overlapped and applied to each of the electrodes 25. In this case, the driving force to carry the toner T can be more effectively obtained.

Seventh Embodiment

Structure of Leveling Electrodes

Figure 12:
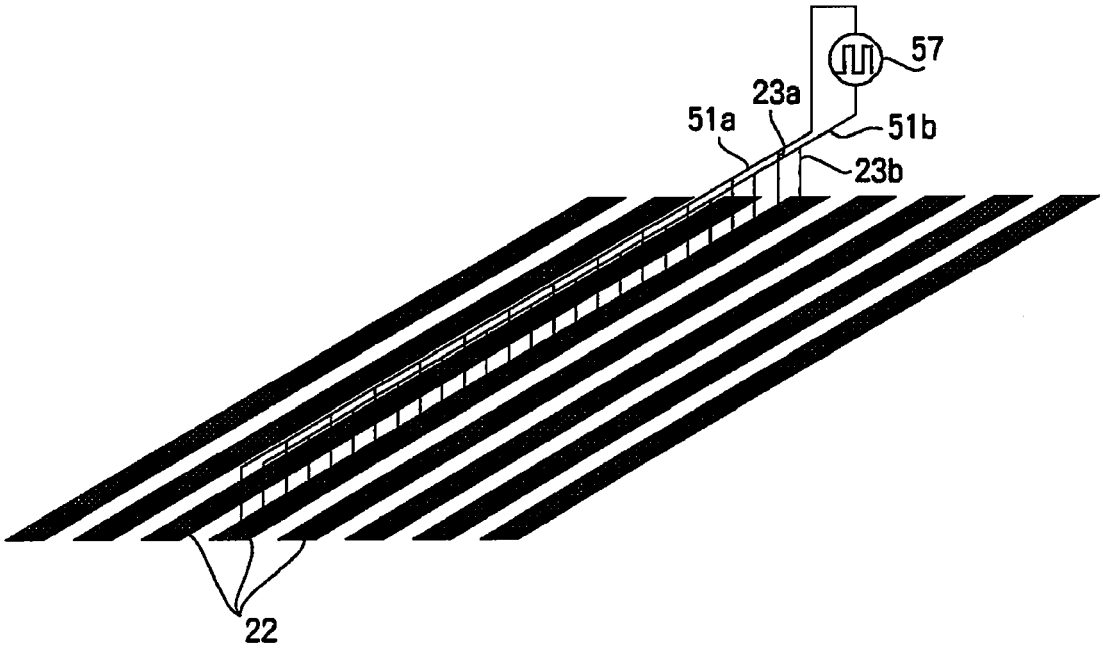
FIG. 12 is a perspective view schematically illustrating a configuration of electrodes on the carrying plate according to a seventh embodiment of the invention.

The configuration of applying an alternating-voltage to each electrode can be applied to the first embodiment. Namely, according to a seventh embodiment schematically illustrated in the FIG. 12, the terminals of the single-phase alternating-voltage supply 57 are connected with electric wires 51*a* and 51*b*, respectively. Electrodes 23*a* and electrodes 23*b* are connected to the electric wires 51*a* and 51*b*, respectively. The electrodes 23*a* and 23*b* are alternately arranged above the linear electrode 22. In this case, alternating electric fields are formed in between the neighboring electrodes 23*a* and 23*b*. Since the direction of the force the toner T receives in the width direction alternates rapidly, the toner T can be more efficiently leveled.

Eighth Embodiment

Structure of Leveling Electrodes

Figure 13:
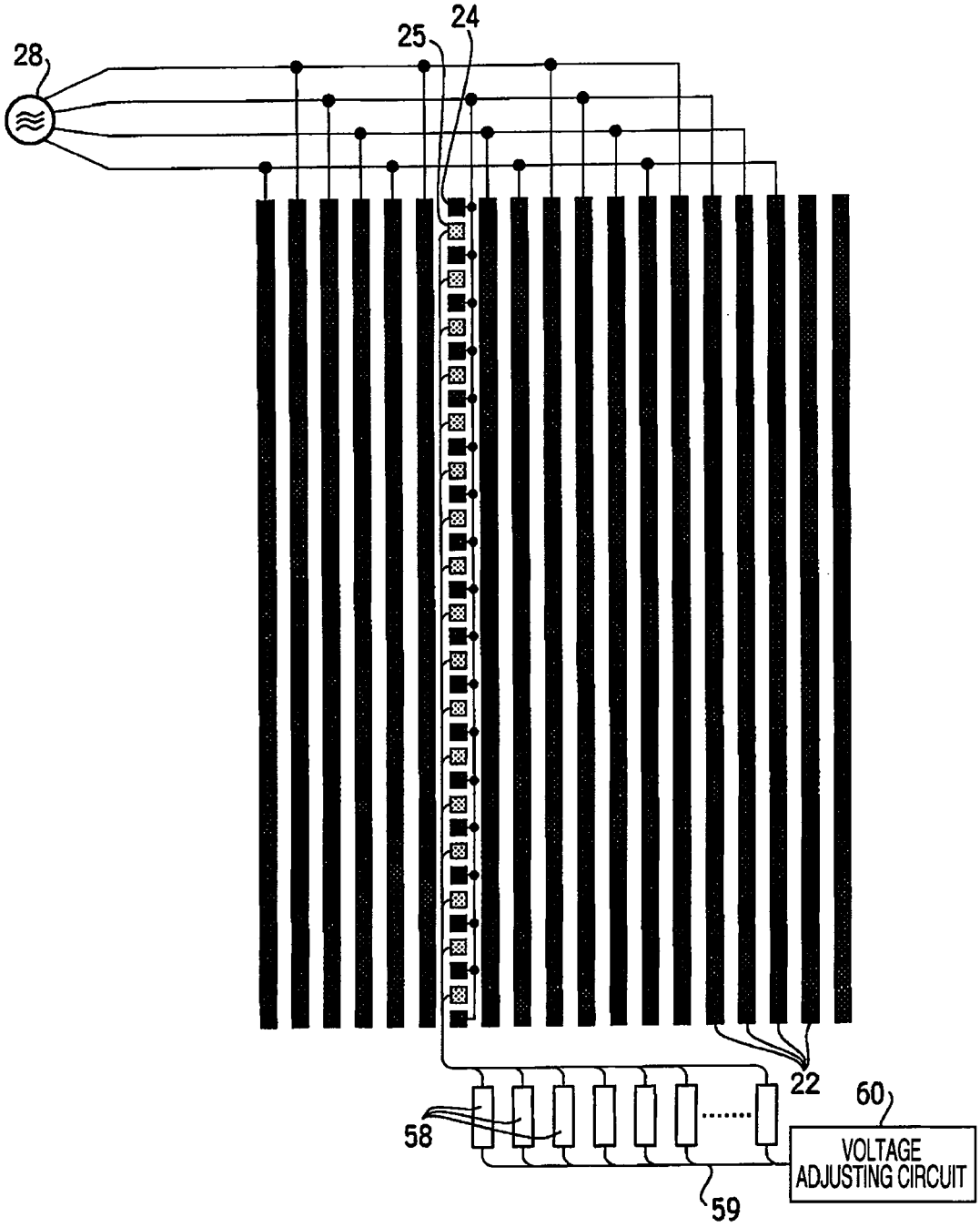
FIG. 13 is a plan view schematically illustrating a configuration of electrodes on the carrying plate according to an eighth embodiment of the invention.

According to an eighth embodiment, the voltages applied to the leveling electrodes are individually adjustable. In the eighth embodiment, as illustrated in FIG. 13, the electrodes 24 and 25 similar to those of the second embodiment are provided. The electrodes 24 are connected to the four-phase rectangular alternating-voltage supply 28, and each electrodes 25 is connected with a variable power supply 58. The voltages applied by the variable power supplies 58 to the electrodes 25 are individually adjustable using a voltage adjusting circuit 60, which is connected to each variable power supply 58 through a signal line 59.

According to the eighth embodiment, the toner T can be more effectively leveled over the width direction by increasing the strength of the electric field at a portion where unevenness tends to arise, or at a portion where a large quantity of toner is carried. The voltages applied from the variable voltage supplies 58 can be appropriately adjusted by a user with referring to the print sheet P on which an image has been formed. However, the voltages can be adjusted automatically as follows.

Application of Eighth Embodiment

Figure 14:
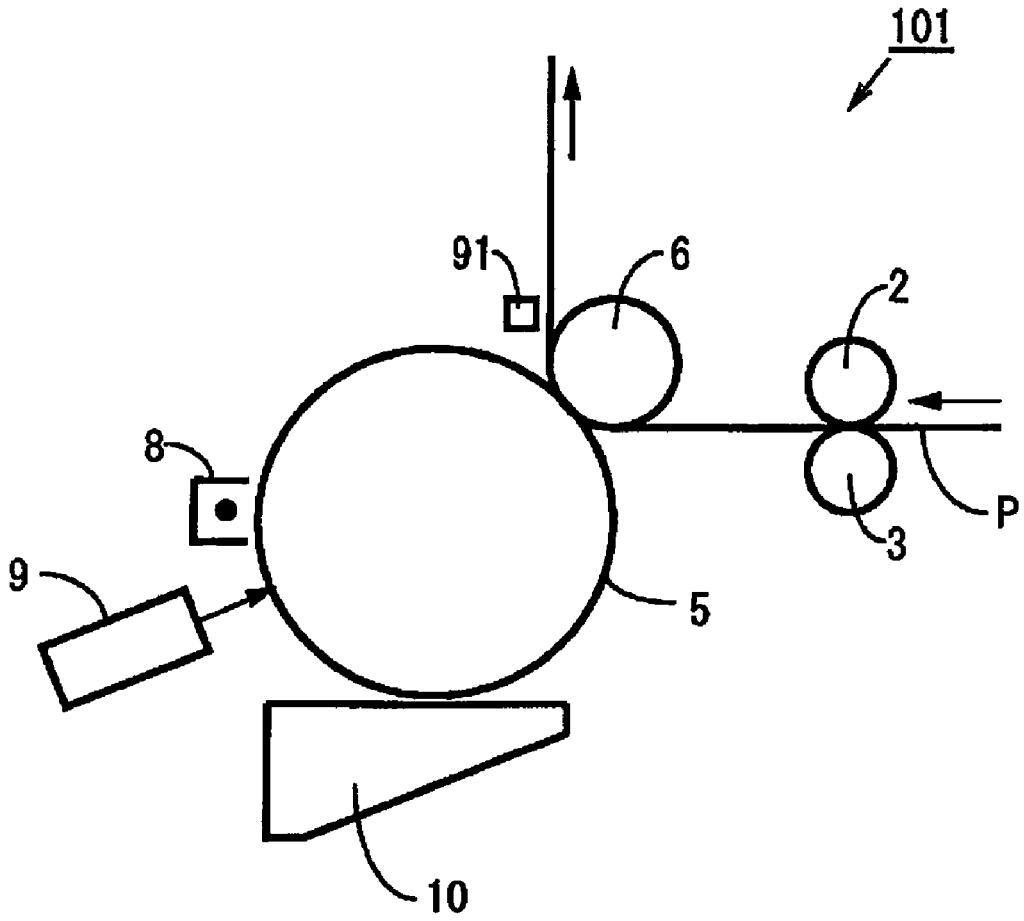
FIG. 14 is a schematic diagram illustrating main units of a laser printer to which leveling electrodes according to an eighth embodiment of the invention are applied.

FIG. 14 schematically shows a configuration of a laser printer 101 employing the eighth embodiment. The configuration of the laser printer 101 is the same as that of the laser printer 1 shown in FIG. 1 except that the laser printer 101 is provided with a scanner 91 which detects a condition of a surface (on which an image has been formed) of the print sheet P, a control unit 92 which is illustrated in FIG. 15, and the variable power supplies 58.

Figure 15:
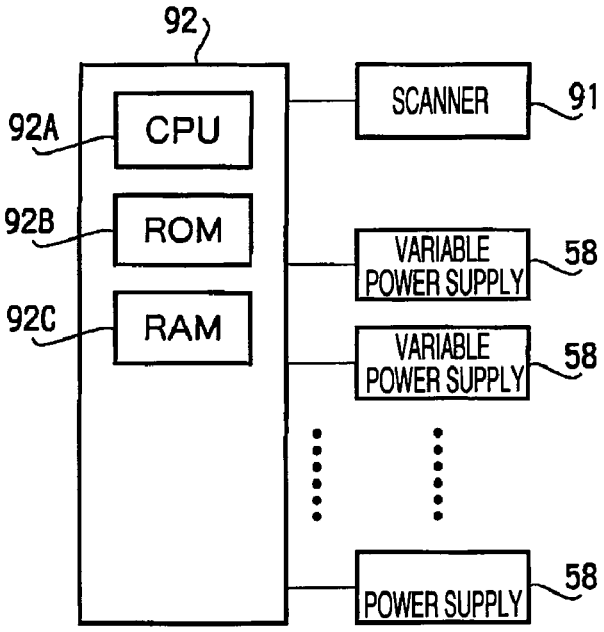
FIG. 15 is a block diagram illustrating a configuration of a control unit of a laser printer according to the eighth embodiment of the invention.

As shown in FIG. 15, the scanner 91 is connected to the control unit 92 which includes a CPU (Central Processing Unit) 92A, a ROM (Read Only Memory) 92B, and a RAM (Random Access Memory) 92C. The control unit 92 is connected with the variable voltage supplies 58 through driving circuits (not shown).

Figure 16:
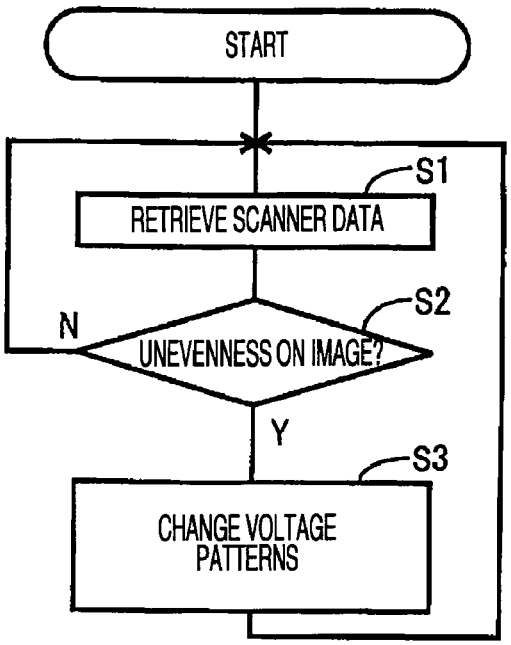
FIG. 16 is a flowchart illustrating a process executed by the control unit according to the eighth embodiment of the invention.

The CPU 92A executes, based on a program stored in the ROM 92B, a process shown in FIG. 16 based on the data (hereinafter, referred to as scanner data) input from the scanner 91. As shown in FIG. 16, the control retrieves the scanner data in S1. Next, the control judges whether there exists an unevenness on the image based on the scanner data (S2). If there exists an unevenness (S2: YES), the CPU 92A adjusts a voltage applying pattern for each of the variable power supplies 58 to eliminate the unevenness on the image (S3). After execution of S3, the process proceeds to S1. If there is no unevenness (S2: NO), then the process directly proceeds to S1 without executing S2. As above, a loop of processing by steps S1 and S2 keeps monitoring whether an unevenness arises or not. In this manner, by adjusting the voltage applying pattern of the voltage applied from each variable power supply 58 in accordance with the unevenness on the image, it is possible to from a suitable image on the print sheet P.

Incidentally, various embodiments can be considered for determining whether there exists an unevenness or not at S2. For example, the control may refer to the image data that is input from an external device in order to drive the laser scanner unit 9. Then, if unevenness of density is detected in a certain area based on the scanner data, despite that the corresponding part of the image forming surface is a so-called solid area, to which the toner T should be transferred uniformly, the control judges that there exists the unevenness since, according to the original image data, the same amount of the toner should have been uniformly distributed in the solid area.

It should be noted that the invention needs not be limited to the configurations of the embodiments described above, but can be practiced in various embodiments within the scope of the invention. For example, the invention can be applied not only to a laser printer, but also to various image forming devices, such as a copying machine or a facsimile machine. Further, the direction in which the leveling electrodes are arranged is not necessarily perpendicular to the direction in which the toner is carried (namely, the direction in which the traveling wave field travels), and it suffices as long as the direction in which the leveling electrodes are arranged intersects with the direction in which the toner is carried. Furthermore, a developer carrying device according to the invention can be applied to a device which merely carries developer without forming images.

What is claimed is:

1. A developer carrying device, comprising:

a plurality of carrying electrodes configured to form a traveling wave field as voltages are sequentially applied thereto, charged developer being carried by an effect of the traveling wave field;

a developer carrying member having a surface on which the plurality of carrying electrodes are arranged; and a plurality of leveling electrodes provided above the surface and configured to form electric fields in a direction intersecting with a direction in which the developer is carried, the plurality of leveling electrodes being needle like electrodes with a longest dimension of each extending in a direction intersecting with the surface, the plurality of leveling electrodes being spaced from each other in a direction intersecting with the direction in which the developer is carried.

2. The developer carrying device according to claim 1, wherein different voltages are applied to any of two neighboring leveling electrodes.

3. The developer carrying device according to claim 2, further comprising a plurality of lines of leveling electrodes, each of the plurality of lines of leveling electrodes comprising a plurality of leveling electrodes aligned with each other in a direction intersecting with the direction in which the developer is carried, the plurality of lines of leveling electrodes being spaced from each other in the direction in which the developer is carried.

4. The developer carrying device according to claim 3, wherein different voltages are applied to any of two neighboring leveling electrodes along the direction in which the developer is carried.

5. The developer carrying device according to claim 3, wherein electric fields formed by a first line of leveling electrodes from the plurality of lines of leveling electrodes are stronger than electric fields formed by a second line of leveling electrodes from the plurality of lines of leveling electrodes, wherein the second line of leveling electrodes is located downstream from the first line of leveling electrodes in the direction in which the developer is carried.

6. The developer carrying device according to claim 1, wherein the electric fields formed by the leveling electrodes in a direction intersecting with the direction in which the developer is carried alternate.

7. The developer carrying device according to claim 1, wherein the electric fields formed by the leveling electrodes in a direction intersecting with the direction in which the developer is carried comprises a plurality of parts, wherein the strength of each is individually adjustable.

8. The developer carrying device according to claim 1, wherein the plurality of carrying electrodes comprise a plurality of linear electrodes, and the plurality of leveling electrodes are arranged above at least one of the linear electrodes.

9. A developer carrying device, comprising:

a plurality of carrying electrodes configured to form a traveling wave field as voltages are sequentially applied thereto, charged developer being carried by an effect of the traveling wave field;

a developer carrying member having a surface on which the plurality of carrying electrodes are arranged; and a plurality of leveling electrodes provided on the surface and configured to form electric fields in a direction intersecting with the direction in which the developer is carried, the plurality of leveling electrodes being aligned with each other in a direction intersecting with a direction in which the developer is carried.

10. The developer carrying device according to claim 9, wherein different voltages are applied to any of two neighboring leveling electrodes.

11. The developer carrying device according to claim 9 further comprising a plurality of lines of leveling electrodes, each of the plurality of lines of leveling electrodes comprising a plurality of leveling electrodes aligned with each other in a direction intersecting with the direction in which the developer is carried, the plurality of lines of leveling electrodes being spaced from each other in the direction in which the developer is carried.

12. The developer carrying device according to claim 11, wherein different voltages are applied to any of two neighboring leveling electrodes along the direction in which the developer is carried.

13. The developer carrying device according to claim 11, wherein electric fields formed by a first line of leveling electrodes from the plurality of lines of leveling electrodes are stronger than electric fields formed by a second line of leveling electrodes from the plurality of lines of leveling electrodes, wherein the second line of leveling electrodes is located downstream from the first line of leveling electrodes in the direction in which the developer is carried.

14. The developer carrying device according to claim 9, wherein the electric fields formed by the leveling electrodes in a direction intersecting with the direction in which the developer is carried alternate.

15. The developer carrying device according to claim 9, wherein strengths of the electric fields formed by the leveling electrodes in a direction intersecting with the direction in which the developer is carried comprises a plurality of parts, wherein the strength of each part is individually adjustable.

16. The developer carrying device according to claim 9, wherein the plurality of carrying electrodes comprise a plurality of linear electrodes, and the plurality of leveling electrodes comprise linearly-aligned electrodes which are arranged between two neighboring linear electrodes.

17. An image forming device, comprising:

an electrostatic latent image supporting member, on a surface of which an electrostatic latent image is formed;

a developer carrying device configured to carry developer to the electrostatic latent image supporting member, the developer carrying device including:

a plurality of carrying electrodes configured to form a traveling wave field as voltages are sequentially applied thereto, charged developer being carried by an effect of the traveling wave field;

a developer carrying member having a surface on which the plurality of carrying electrodes are arranged; and a plurality of leveling electrodes provided above the surface and configured to form electric fields in a direction intersecting with a direction in which the developer is carried, the plurality of leveling electrodes being needle like electrodes with a longest dimension of each extending in a direction intersecting with the surface, the plurality of leveling electrodes being spaced from each other in a direction intersecting with the direction in which the developer is carried; and a transferring unit configured to transfer the developer, which is supplied from the developer carrying device to the electrostatic latent image supporting part, to a recording medium.

18. An image forming device, comprising:

an electrostatic latent image supporting member, on a surface of which an electrostatic latent image is formed;

a developer carrying device configured to carry developer to the electrostatic latent image supporting member, the developer carrying device including:

a plurality of carrying electrodes configured to form a traveling wave field as voltages are sequentially applied thereto, charged developer being carried by an effect of the traveling wave field;

a developer carrying member having a surface on which the plurality of carrying electrodes are arranged; and a plurality of leveling electrodes provided on the surface and configured to form electric fields in a direction intersecting with the direction in which the developer is carried, the plurality of leveling electrodes being aligned with each other in a direction intersecting with a direction in which the developer is carried; and a transferring unit configured to transfer the developer, which is supplied from the developer carrying device to the electrostatic latent image supporting part, to a recording medium.

* * * * *